United States Patent [19]

Karasin et al.

[11] Patent Number: 4,974,727

[45] Date of Patent: Dec. 4, 1990

[54] VENTED PACKAGE FOR HOLDING A PLURALITY OF DISPENSERS

[75] Inventors: Craig E. Karasin, Orangetown, N.Y.; Joseph Thompson, Upper Saddle River, N.J.

[73] Assignee: Sterling Drug Inc., Rensselaer, N.Y.

[21] Appl. No.: 391,895

[22] Filed: Aug. 10, 1989

Related U.S. Application Data

[62] Division of Ser. No. 84,571, Aug. 12, 1987, Pat. No. 4,878,774.

[51] Int. Cl.[5] ..... B65D 69/00; B65D 51/16; A46B 11/00

[52] U.S. Cl. ..... 206/229; 206/45.34; 220/23; 220/366; 220/367; 401/125

[58] Field of Search ..... 401/123, 124, 125, 129, 401/126, 118, 119; 206/229, 45.34, 45.31; 220/23, 366, 367; D9/338

[56] References Cited

U.S. PATENT DOCUMENTS

| | | | |
|---|---|---|---|
| D. 101,741 | 10/1936 | Klein | D9/338 X |
| D. 252,794 | 9/1979 | Lucas | D9/338 |
| 1,164,979 | 12/1915 | Benko | 206/229 X |
| 1,180,391 | 4/1916 | Gatzen | 206/229 X |
| 2,403,575 | 7/1946 | Brack | 401/125 |
| 2,834,975 | 5/1958 | Perwas | 401/124 |
| 3,000,035 | 9/1961 | Harris et al. | 220/23 X |
| 3,136,453 | 6/1964 | Patton et al. . | |
| 3,223,096 | 12/1965 | Goldberg et al. | 401/123 X |
| 3,318,488 | 5/1967 | Barnes . | |
| 3,429,653 | 2/1969 | Brett | 206/459 |
| 3,794,090 | 2/1974 | Commisso | 220/306 |
| 3,802,024 | 4/1974 | Fenster | 206/229 X |
| 3,847,299 | 11/1974 | Page | 220/4 F |
| 3,848,803 | 11/1974 | Levey . | |
| 3,941,275 | 3/1976 | Simmons | 220/23 X |
| 3,999,680 | 12/1976 | Cho | 220/366 |
| 4,144,967 | 3/1979 | Craven et al. | 206/229 |
| 4,162,010 | 7/1979 | Hovsepian | 206/229 |
| 4,390,113 | 6/1983 | Bird | 220/306 |
| 4,527,574 | 7/1985 | Manfredi | 401/125 X |
| 4,576,309 | 3/1986 | Tzifkansky et al. | 220/366 |
| 4,630,954 | 12/1986 | Ladd, Jr. | 401/123 |
| 4,645,366 | 2/1987 | Frohn | 401/123 |
| 4,750,614 | 6/1988 | Fischer et al. | 206/45.31 |

FOREIGN PATENT DOCUMENTS

| | | | |
|---|---|---|---|
| 1101727 | 4/1955 | France | 401/123 |
| 17735 | of 1914 | United Kingdom | 220/23 |

*Primary Examiner*—Bryon P. Gehman
*Attorney, Agent, or Firm*—John R. Everett

[57] ABSTRACT

A vented package for a plurality of dispensers for flowable products. The vented package includes a base member having a fluid passage therein and an overcap having an aperture therein to allow venting of product vapors which escape from the dispensers. The dispenser includes a container body, a mounting member fitted on the container body and a dispensing head such as an applicator head movably mounted on the mounting member. The mounting member includes an axially extending closure member with a pin member thereon. The dispensing head includes an aperture and a skirted chamber beneath the aperture, the skirted chamber including slits for controlling flow of material into the skirted chamber from the container body. The dispensing head is movable from an open position to a closed position wherein the closure member fits within the skirted chamber and the pin member fits within the aperture.

12 Claims, 7 Drawing Sheets

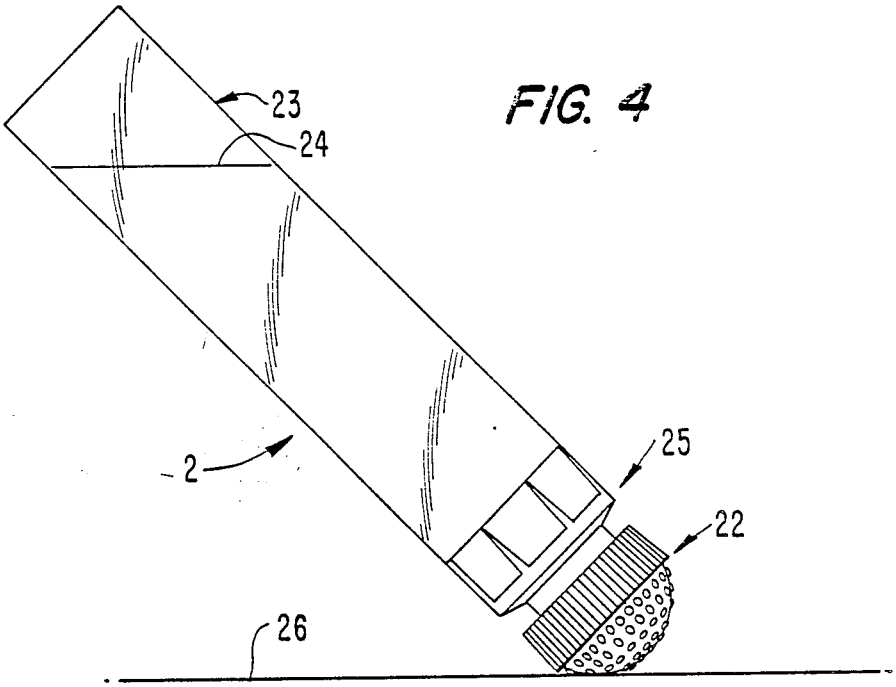
FIG. 4
FIG. 5
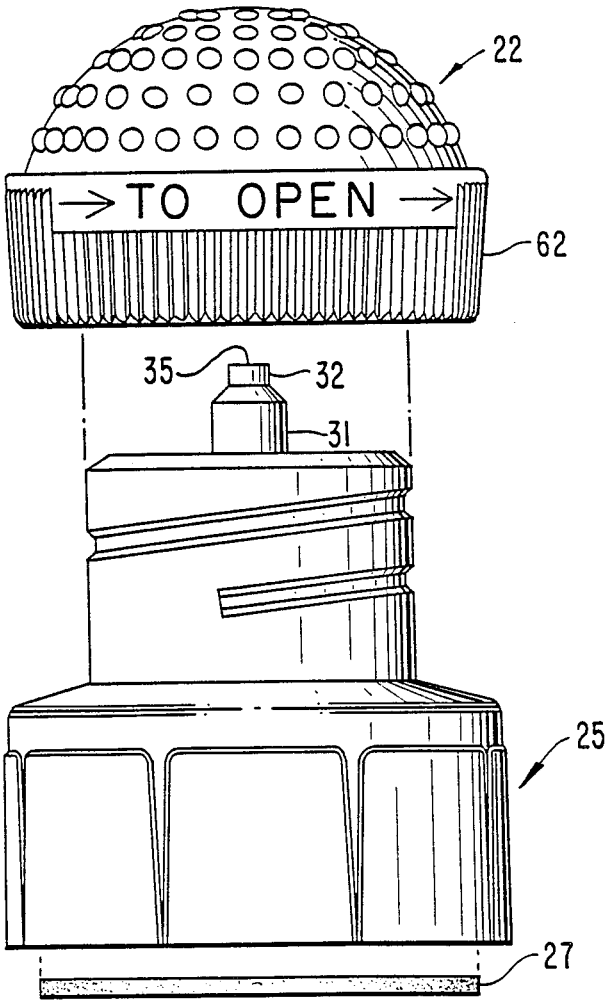

VENTED PACKAGE FOR HOLDING A PLURALITY OF DISPENSERS

This is a Rule 60 Divisional application of aplication Ser. No. 07/084,571 filed Aug. 12, 1987, now U.S. Pat. No. 4,878,774.

BACKGROUND OF THE INVENTION

1. Field of the Invention.

The present invention relates to a dispenser having a dispensing head, particularly a dispenser including an applicator head, a squeezable container body for application of a flowable liquid -through the applicator head, and a vented package for holding a plurality of the dispensers.

2. Background of the Invention.

Various two piece closures are known in the art wherein one member includes an axially extending pin and the other member includes an aperture aligned with the pin and a skirted chamber surrounding the pin. Such two piece closures are disclosed by Kitterman (U.S. Pat. No. 3,157,323), Kessler (U.S. Pat. No. 3,276,640), Nixdorff (U.S. Pat. No. 4,020,981) and Page, III (U.S. Pat. No. 4,383,623). Manufacturers of such devices include Calmar Dispensing Systems of Watchung, N.J. which makes a Modified Calmar Auto Cap, U.S. Cap of Saddle Brook, N.J. which makes a Push-Pull Cap, Product Design and Engineering, Inc. of Minneapolis, Minn., Gibson Associates, Inc. of Cranford, N.J., Stull Engraving Company of Garfield, N.J. and Seaquist Closures of Crystal Lake, Ill.

Various dispensers having applicators extending therefrom are known in the art. Such dispensers include those taught by Vartoughian (U.S. Pat. No. 4,447,169), Cropton (U.S. Pat. No. 3,915,577), Deakers (U.S. Pat. No. 2,716,250), Ward (U.S. Pat. No. 3,468,611), Van Sant (U.S. Pat. No. 1,621,567), Stull (U.S. Pat. No. 3,844,455), Moe et al. (U.S. Pat. No. 4,279,527) and Arbitman et al. (U.S. Pat. No. 3,229,866). Each of the dispensers disclosed in these patents differs from that of the present invention in one or more ways.

Various vented packages are known in the art, such packages including those taught by Brett (U.S. Pat. No. 3,429,653), Page et al. (U.S. Pat. No. 3,847,299), Commisso (U.S. Pat. No. 3,794,090) and Bird (U.S. Pat. No. 4,390,113). Other vented containers include those taught by Cho (U.S. Pat. No.3,999,680) and Tzifkansky et al. (U.S. Pat. No. 4,576,309). Hovsepian (U.S. Pat. No. 4,162,010).teaches a container body having recesses distributed around an open top thereof. Each of the containers disclosed in these patents differs from the vented package of the present invention in one or more ways.

Containers having ratchet means to prevent unintentional removal of the closures thereof are well known in the art and are exemplified by the patents to Burke (U.S. Pat. No. 4,345,691), Willis (U.S. Pat. No. 3,954,200), Coe (U.S. Pat. No. 1,568,657), McNamara et al. (U.S. Pat. No. 2,153,426), Spencer (U.S. Pat. No. 2,889,081), Johns (U.S. Pat. No. 3,294,293), Quackenbush (U.S. Pat. No. 3,422,978), Marand (U.S. Pat. No. 3,717,287), Hazard (U.S. Pat. No. 3,977,557), Haller (U.S. Pat. No. 4,065,037), Uhlig (U.S. Pat. Nos. 4,209,100 and 4,533,058), Gach (U.S. Pat. No. 4,236,653), Stull (U.S. Pat. No. 4,281,778), Lohrman (U.S. Pat. No. 4,358,031), Kirk, Jr. (U.S. Pat. No. 4,366,921), Uhlig et al. (U.S. Pat. No. 4,220,262), Barker et al. (U.S. Pat. No. 4,550,862) and Ryder (U.S. Pat. No. 4,605,135).

SUMMARY OF THE INVENTION

The present invention is directed to a vented package for holding a plurality of dispensers which contain volatile products such as spot remover volatile liquid products, the vented package including vent means for preventing loss in tensile strength and crazing of an overcap of the package due to natural slight loss of product vapors through the closures of the dispensers.

The present invention is also directed to a dispenser comprising a container body, particularly a squeezable bottle, a mounting member fitted on one end of the container body, the mounting member having a flow passage therethrough in fluid communication with an opening in the container body, the mounting member including a closure member extending in an axial direction, and a dispensing head movably mounted on the mounting member, the dispensing head being movable in the axial direction towards the mounting member to a closed position and movable in the axial direction away from the mounting member to an open position and having at least one aperture therein for dispensing a flowable substance stored in the container body, the closure member including aperture sealing means for sealing the at least one aperture when the dispensing head is moved to the closed position, the dispensing head further including a skirted chamber in fluid communication with the at least one aperture, the skirted chamber being defined by a radially inner surface of an axially extending wall of the dispensing head, the inner surface sealingly engaging the closure member when the dispensing head is in the open and closed positions, the skirted chamber including means for controlling flow of the flowable substance from the flow passage of the mounting member into the skirted chamber so that excess dripping of the flowable substance from the dispensing head is avoided during use thereof.

In a preferred embodiment the dispensing head is in the form of an applicator head, the applicator head having applicator means thereon for distributing a flowable substance stored in the container body over an article to which the flowable substance is to be applied. Also, the closure member can have a pin member thereon extending in the axial direction away from the container body. In this case, the applicator head includes a single aperture sized for sealingly engaging the pin member when the applicator head is in the closed position.

Other features of the present invention include a hemispherical shaped axial end surface forming part of the applicator head and a plurality of projections on the hemispherical surface comprising the applicator means. The mounting member includes a tubular portion extending in the axial direction with the closure member being disposed radially inward of an inner surface of the tubular portion, the dispensing head including means thereon for sealingly engaging the inner surface of the tubular portion when the dispensing head is in any position between and including the open and closed positions. The dispensing head also includes means for sealingly engaging an outer surface of the tubular portion when the dispensing head is in any position between and including the open and closed positions.

The flow control means of the present invention comprises at least one slit extending through the wall of the dispensing head defining the skirted chamber, the slit being closed by the closure member when the dispensing head is in the closed position.

The dispensing head can be mounted on the mounting member by either screw connection means or push-pull means for allowing the dispensing head to move axially between the open and closed positions by either rotating the dispensing head in relation to the mounting member or manually pulling and pushing on the dispensing head in relation to the mounting member. When the dispensing head includes applicator means, the applicator head and mounting member preferably include friction means for inhibiting movement of the applicator head from the open to the closed position by means of the push-pull means. The friction means comprises a projection on the mounting member and an engaging member on the applicator head, the engaging member contacting the projection when the applicator head is moved from the open position to the closed position, the projection causing the engaging member to flex in a direction transverse to the axial direction for passage of the engaging member over the projection when the applicator head is moved to the closed position.

The dispenser of the present invention also includes means for preventing dripping of the flowable substance therefrom after the dispensing head has been used and then placed in an upright position, the dripping preventing means comprising a radially outwardly and upwardly extending lip on the outer edge of the dispensing head. The dispenser of the present invention also includes mean for preventing removal of the mounting member from the container body, the removal preventing means comprising a plurality of ratchet teeth on a lower portion of the mounting member and a plurality of lugs on the container body, the mounting member being threadedly engaged with the container body and the ratchet teeth being flexible radially outwardly for passing over radially outer surfaces of the lugs when the mounting member is rotated in one, direction into engagement with the container body, the lugs having radially extending locking surfaces for engaging the ratchet teeth to prevent removal of the mounting member by rotation thereof in the opposite direction.

BRIEF DESCRIPTION OF THE DRAWINGS

The invention will be described with reference to the accompanying drawings, in which:

FIG. 4 shows a dispenser with an applicator head of the present invention in a position for treating an article with a flowable substance contained in the dispenser;

FIG. 5 shows details of one embodiment of a mounting member and an applicator head forming part of a dispenser of the present invention;

DETAILED DESCRIPTION OF THE PREFERRED EMBODIMENTS

Figure 1:
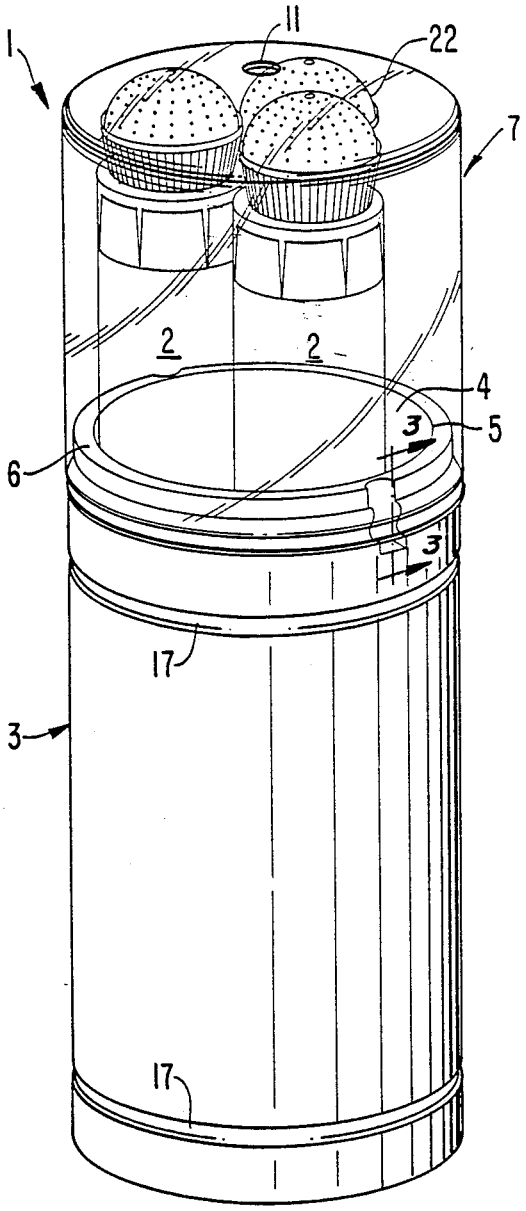
FIG. 1 shows the vented package of the present invention containing three dispensers with applicator heads according to the present invention.

FIG. 1 shows a vented package 1 of the present invention for containing a plurality of dispensers 2 according to the present invention. The vented package 1 comprises a base member 3 extending in a longitudinal direction and having a cavity 4 therein for receiving at least one of the dispensers 2, the cavity 4 forming an opening 5 in a peripheral surface of an upper end 6 of the base member 3. An overcap 7 extends in the longitudinal direction and has a lower end 8 removably fitted over the opening 5 in the base member 3. That is, the overcap 7 is removable from the opening 5 but need not be completely removable from the base member 3. Vent means is disposed on at least one of the base member 3 and the overcap 7 for preventing loss in tensile strength and crazing of the overcap 7 due to natural slight loss of product vapors through the closures of the dispensers 2 when the dispensers are contained in the vented package 1.

The overcap 7 comprises a clear plastic material having a rim 9 at the lower end 8 of the overcap 7. The base member 3 includes a ridge 10 around the upper end 6 thereof engageable with the rim 9 of the overcap 7 for removably securing the overcap 7 and the base member 3 together.

In a first embodiment, the vent means comprises at least one aperture 11 extending through the overcap 7, the aperture 11 being spaced from a portion of the overcap removably fitted over the opening 5 in the base member 3. The vent means further comprises at least one fluid passage 12 between the overcap 7 and the base member 3 although the fluid passage can comprise one or more holes extending through either the overcap 7 or the base member 3 in the vicinity of the opening 5, whereby venting of vapors having a density greater than air is effected by passage of air into the vented package through the aperture 11 and passage of vapors and air out of the vented package through the fluid passage 12 between the overcap 7 and the base member 3. It has been found that dispensers containing spot remover products inevitably produce some vapor loss through the applicator closures of the dispensers and such product vapors cause one or more of loss in tensile strength of plastic packages and-discoloration and crazing of clear overcaps of such plastic packages. The present invention overcomes this problem by providing a plurality of vents in the package to eliminate this chemical degradation. The vents must be placed at suitable locations and provide a sufficient aggregate area relative to the total volume of head space within the package to result in adequate venting. Thus, with dispensers containing solvents of specific gravity greater than air, the vent holes are most advantageously placed below the level of the closure between a base member and an overcap of the package. Furthermore, since the formulas of such spot remover products are complex, it is advantageous to put at least one vent above the level of the lower base member, such as one or more vent holes in the clear plastic overcap. This arrangement permits venting of vapors having a density less than air by allowing air to pass into the package through the vent holes in the overcap to thereby carry product vapors out of the vent holes located below the applicator closures of the dispensers. Thus, the number of vent holes and the locations thereof can be determined based on the volume of head space within the package and depending upon the specific product contained in the dispensers.

Figure 2:
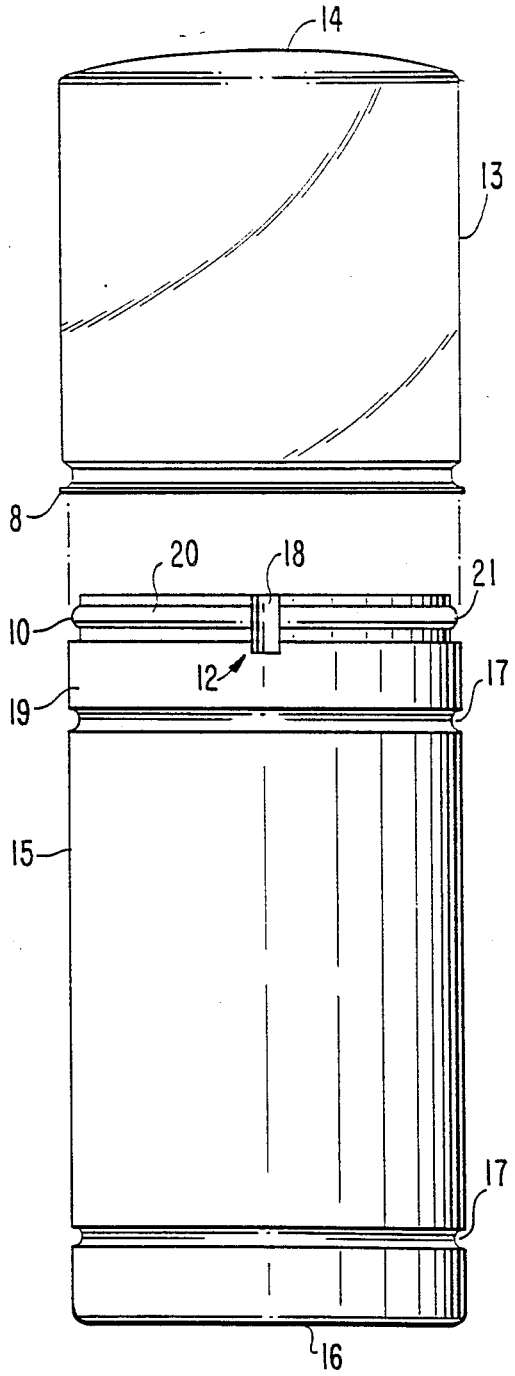
FIG. 2 shows the vented package with the overcap thereof removed from the base member thereof as well as a fluid passage on the outer periphery of the base member.
Figure 3:
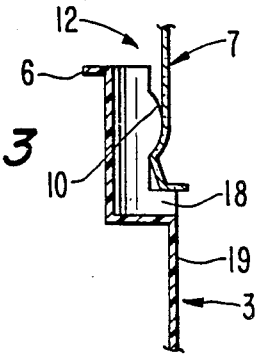
FIG. 3 shows the fluid passage taken along the lines 3—3 shown in FIG. 1.
Figure 2A:
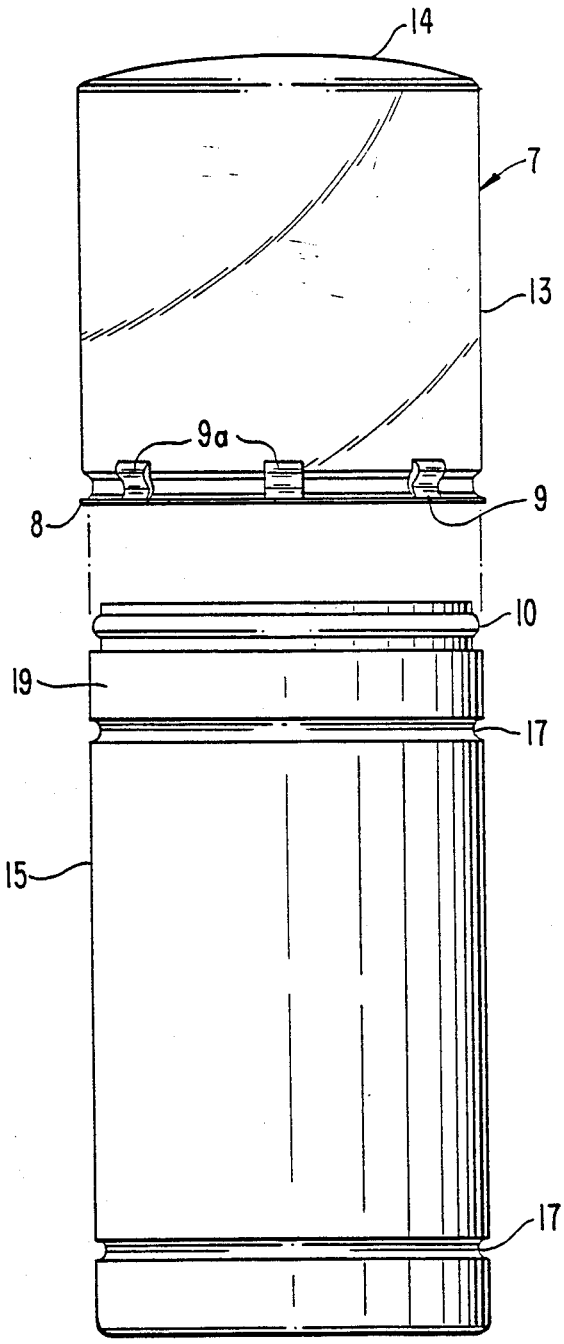
FIG. 2A shows another embodiment of the vented package wherein the fluid passage is formed by a plurality of longitudinally extending channels in the inner periphery of the overcap.
Figure 3A:
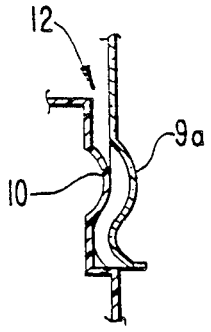
FIG. 3A shows a cross sectional view of one of the channels shown in FIG. 2A when the overcap is fitted on the base member.

In the first embodiment shown in FIGS. 1 and 2, the overcap comprises a cylindrical tubular member 13 closed at an upper end thereof by a top wall 14, the aperture 11 being disposed in the top wall 14 of the overcap 7. The base member can comprise a cylindrical tubular body 15 closed at one end thereof by a bottom wall 16, the tubular body 15 including at least one strengthening rib 17 extending circumferentially therearound. The fluid passage 12 comprises a recess 18 extending radially inwardly from an outer periphery 19 of the tubular body 15, the recess 18 extending in the longitudinal direction towards the opening 5 in the base member 3 and separating the ridge 10 on the base member 3 into first and second sections 20, 21. The recess 18 allows for passage of gasses inwardly and outwardly of the vented package 1. In the specific embodiment shown in FIG. 1, there is provided a pair of fluid passages 12. Also shown in FIG. 1 is a plurality of dispensers 2 having applicator heads 22 at one end thereof, the dispensers 2 being stored in the vented package 1 with the applicator heads 22 located within and adjacent to the top wall 14 of the overcap 7. The vented container 1 shown in FIG. 1 is specifically adapted to hold three dispensers 2.

In another embodiment of the vented package, the vent means comprises the at least one aperture 11 extending through the overcap 7, as shown in FIG. 1, and at least one channel **9*a* in an inner surface of the overcap 7 at a lower end thereof. In particular, the overcap 7 can include three pairs of diametrically opposed longitudinally extending channels 9*a* formed longitudinally in the inner surface of the rim 9 at the lower end of the overcap 7. The channels 9*a* form a space between an outer periphery of the base member 3 and the inner surface of the overcap 7 to allow passage of gasses inwardly and outwardly of the vented package 1. In addition to providing venting of the vented package 1, the channels 9*a*** also perform the function of reducing stress cracking of the lower end of the overcap during removal thereof due to the sudden radially inward deformation of the lower end of the overcap as it disengages the base member.

The following description relates to the dispenser 2 of the present invention and the various embodiments thereof. In the preferred embodiment, dispenser 2 has a specific type of applicator means associated therewith as more fully described below. However, it will be understood that dispensing heads having applicator means other than that of FIG. 2 associated therewith or having no applicator means therewith are included within the scope of the invention.

The dispenser 2 comprises a container body 23 which can be rigid or squeezable for containing a flowable substance 24, a mounting member 25 and the applicator head 22. The dispenser 2 is used by inclining the container body 23 to rub the applicator head 22 on an article 26 to be treated as shown in FIG. 4. FIGS. 5–8 show one embodiment of the applicator head 22 which is actuated by a screw connection means between the applicator head 22 and the mounting member 25. As shown in FIG. 5, the mounting member 25 includes a ring seal 27 for sealing the mounting member to the container body 23.

Figure 8:
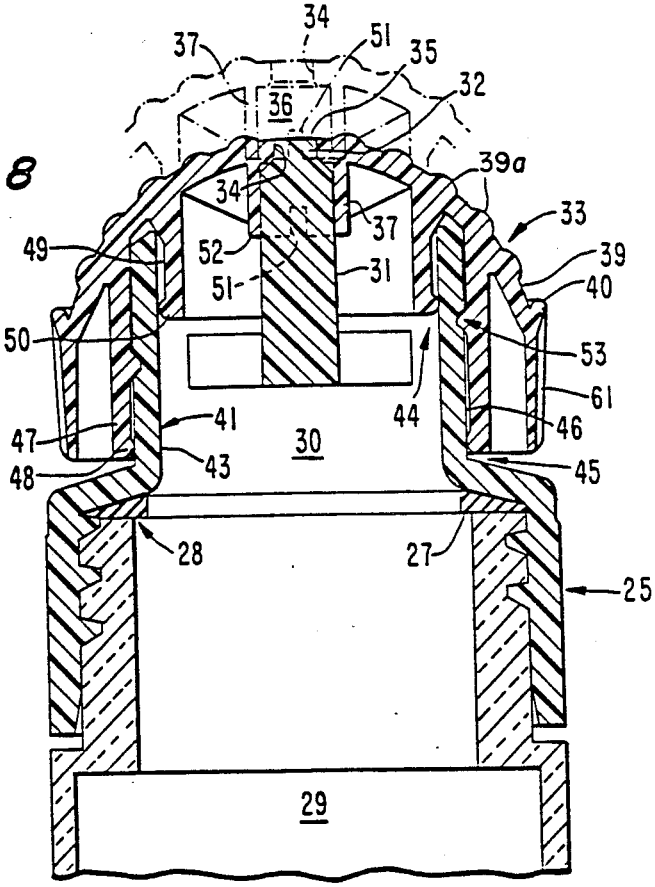
FIG. 8 shows a cross-sectional view of the applicator head and mounting member of FIG. 5 wherein the mounting member is attached to a container body and the applicator head is shown in solid lines in a closed position on the mounting member and is shown in phantom in an open position on the mounting member.

The mounting member 25 is shown in more detail in FIG. 8 wherein the mounting member 25 is shown attached to the container body 23 having an opening 28 at the top end thereof and a cavity 29 within the container body 23. The mounting member includes a flow passage 30 therethrough in fluid communication with the opening 28 in the container body 23. The mounting member includes a closure member 31 extending in an axial direction and aperture sealing means thereon for sealing a dispensing aperture in the applicator head, the aperture sealing means comprising a pin member 32 disposed on the closure member 31 extending in the axial direction away from the container body 23. While the closure member 31 is cylindrical in cross-section in the preferred embodiment, it can have other cross-sectional shapes.

The applicator head 22 is movably mounted on the mounting member 25, the applicator head 22 being movable in the axial direction towards the mounting member 25 to a closed position (as shown in solid lines in FIG. 8) and the applicator head 22 being movable in the axial direction away from the mounting member 25 to an open position (shown in dotted lines in FIG. 8). The applicator head includes applicator means 33 thereon for distributing the flowable substance 24 stored in the container body 23. The applicator head 22 also includes at least one aperture 34 and in the preferred embodiment comprises a single aperture 34 in axial alignment with the pin member 32 of the mounting member 25, the aperture 34 being sized for sealingly engaging the pin member 32 therein when the applicator head 22 is moved to the closed position. Of course, a single aperture 34 or a plurality of apertures 34 could be provided in the applicator head 22 and the closure member 31 could include aperture sealing means other than the pin member 32 for closing such apertures 34 when the applicator head is in the closed position. For instance, the upper end surface of the closure member 31 could be shaped to sealingly engage the undersurface of the applicator head 22 to thereby seal the aperture 34 or the plurality of apertures 34 in the applicator head 22. However, in the preferred embodiment, the pin member 32 has an axial end surface 35 thereof spaced from the aperture 34 when the applicator head 22 is moved to the open position. The applicator head 22 further includes a skirted chamber 36 in fluid communication with the aperture 34, the skirted chamber being defined by a radially inner surface of an axially extending wall 37 of the applicator head 22. The axially extending wall 37 has a cross-sectional shape such that the inner surface thereof sealingly engages the outer surface of the closure member 31 when the applicator head 22 is in the open and closed positions whereby the flowable substance in the flow passage 30 is prevented from passing between the sealingly engaged portions of the wall 37 and the closure member 31. The skirted chamber also includes means for controlling the rate of flow of the flowable substance 24 from the flow passage 30 of the mounting member 25 through the wall 37 and into the skirted chamber 36 so that dripping of the flowable substance from the applicator means 33 is avoided during use thereof.

Figure 9:
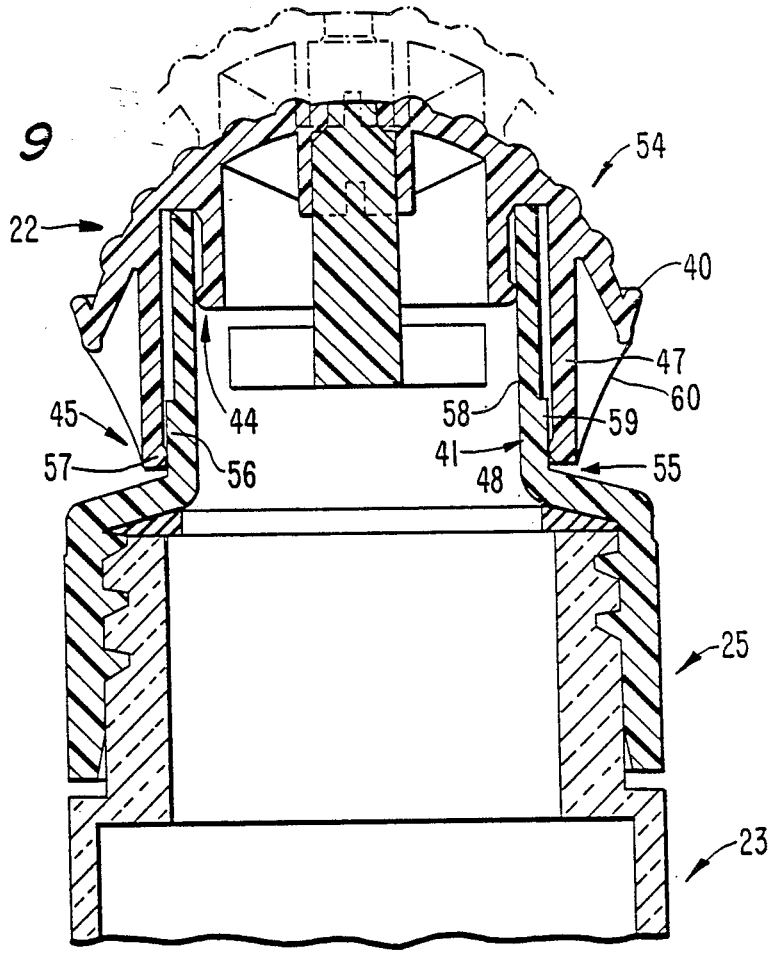
FIG. 9 shows a modification of the applicator head shown in FIG. 5.
Figure 10:
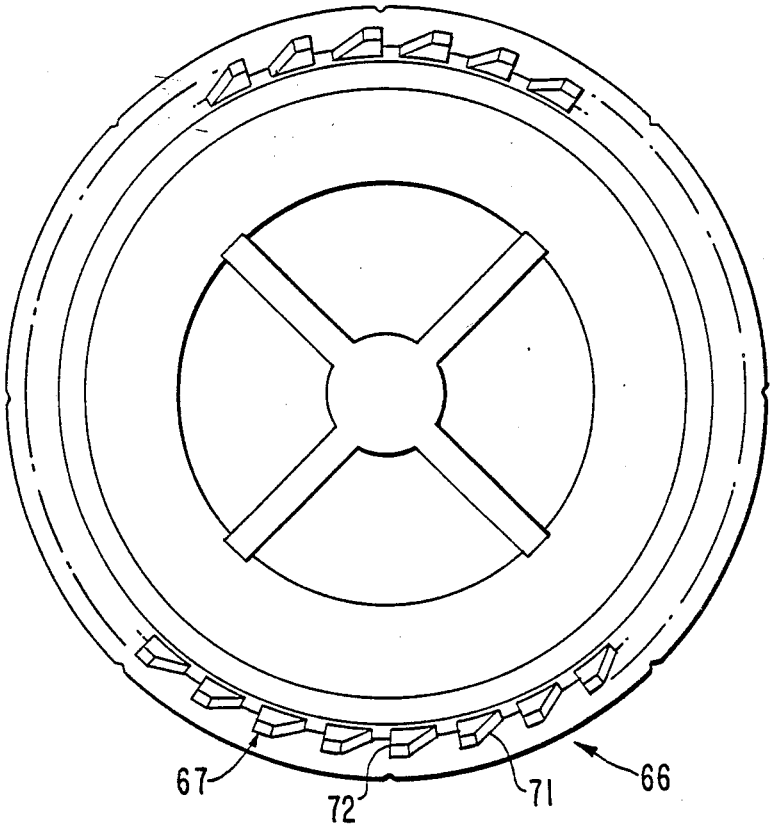
FIG. 10 shows a bottom view of a modified mounting member which includes ratchet teeth depending from a bottom edge of the mounting member.
Figure 11:
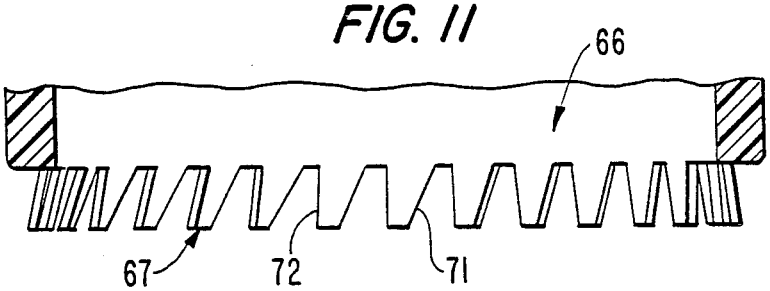
FIG. 11 shows a cross-sectional side view of the mounting member shown in FIG. 10.
Figure 12:
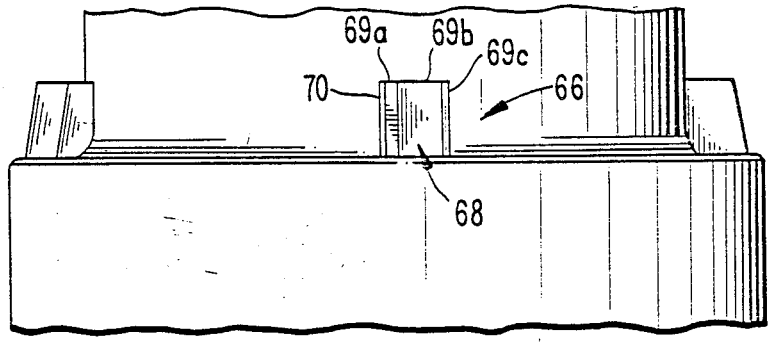
FIG. 12 shows a modified container body including lugs for engaging the ratchet teeth of the mounting member to prevent removal of the mounting member once it is attached to the container body.
Figure 13:
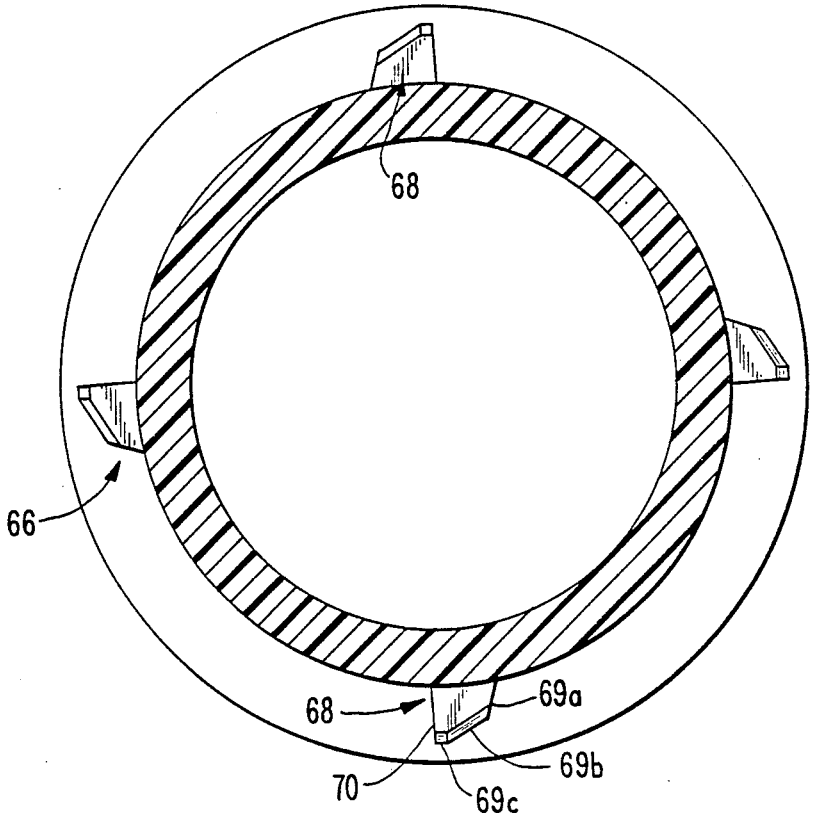
FIG. 13 shows a top cross-sectional view of the container body shown in FIG. 12.

As shown in FIGS. 4, 8 and 9, the applicator means 33 of the applicator head 22 includes a hemispherical shaped axial end surface 39 having the aperture 34 therethrough and a plurality of projections 39*a* distributed over the hemispherical surface 39. In the embodiment shown, the projections comprise round protrusions distributed in concentric rows around the aperture 34. Of course, other shaped projections and patterns of their distribution on the hemispherical surface 39 could be used. On the outer edge of the hemispherical surface 39 is a means 40 for preventing dripping of the flowable substance 24 from the applicator head 22 after the applicator head has been used and then placed in an upright position. The dripping preventing means 40 comprises a radially outwardly and upwardly extending lip, as shown in FIGS. 8 and 9. The lip 40 is thus effective to catch any remaining flowable substance on the hemispherical surface 39 which flows by gravity into the lip 40.

Figure 6:
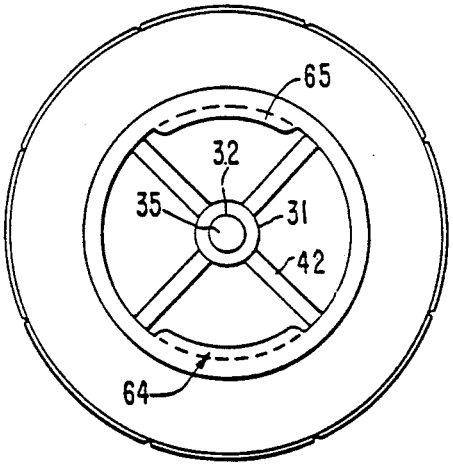
FIG. 6 shows a top view of the mounting member shown in FIG. 5.
Figure 7:
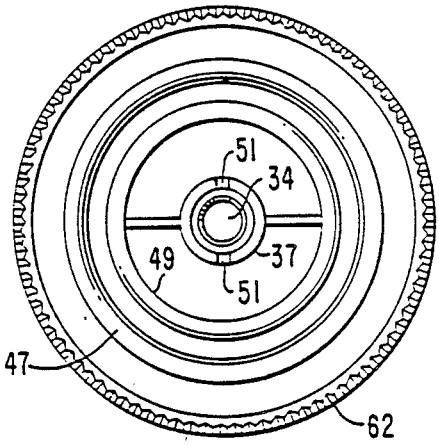
FIG. 7 shows a bottom view of the applicator head shown in FIG. 5.

The mounting member 25 includes a tubular portion 41 which extends in the axial direction away from the container body 23. The closure member 31 is attached to radially extending struts 42 which connect the closure member 31 to an inner surface 43 of the tubular portion 41. As seen in FIG. 6, four struts 42 connect the closure member 31 to the tubular portion 41. The entire mounting member 25 comprising the tubular portion 41, the struts 42, the closure member 31 and the pin member 32 are molded integrally in one piece from plastic. The applicator head 22 includes means 44 thereon for sealingly engaging the inner surface 43 of the tubular portion 41 when the applicator head 22 is in any position between and including the opened and closed positions. The applicator head 22 also includes means 45 for sealingly engaging an outer surface 46 of the tubular portion 41 when the applicator head 22 is in any position between and including the open and closed positions. As shown in FIGS. 8 and 9, the means 45 for sealingly engaging the outer surface 46 of the tubular portion 41 comprises a cylindrical sleeve 47 depending from a bottom surface of the applicator means 33 and a circumferentially extending rim 48 at the lower end of the cylindrical sleeve 47. Likewise, the means 44 for sealingly engaging the inner surface 43 of the tubular portion 41 comprises another cylindrical sleeve 49 disposed radially inward of the first cylindrical sleeve 47 and a circumferentially extending rim 50 at a lower end of the cylindrical sleeve 49. Thus, as the applicator head 22 moves between the open and closed positions, the rims 48, 50 engage the outer surface 46 and the inner surface 43 of the tubular portion 41. Also, when the applicator head 22 is in the closed position, an upper end of the tubular portion engages the underside of the applicator means 33.

The flow control means on the applicator head 22 comprises at least on opening through the axially extending wall 37 forming the skirted chamber 36. In the embodiment shown in FIG. 7, the flow control means comprises a pair of axially extending slits 51 located at the bottom end 52 of the axially extending wall 37. Each of the slits 51 has a length in the axial direction to allow flow of the flowable substance 24 from the flow passage 30 to the space defined by the skirted chamber 36 when the applicator head 22 is in the open position. However, the slits 51 are closed by the closure member 31 when the applicator head 22 is in the closed position. Thus, flow of the flowable substance 24 is prevented by the engagement of the closure member 31 with the inner surface of the axially extending wall 37 and the engagement of the pin member 32 in the aperture 34. More importantly, the slits 51 allow a slower feed of the flowable substance 24 when the dispenser 2 is in the use position shown in FIG. 4. Otherwise, if the bottom end 52 of the skirted chamber 36 was located above the closure member 31 when the applicator head 22 is in the open position, too much of the flowable substance 24 would pass out of the aperture 34 with the result that dripping of the flowable substance 24 would occur even when the container is not squeezed when a squeeze bottle is used instead of a rigid bottle. Such a situation would lead to waste of the flowable substance and dispensing of the flowable substance 24 before it was needed. The dispenser of the preferred embodiment allows the flowable substance to be dispensed when needed by squeezing the container body 23. The desired flow rate of the flowable substance 24 can be adjusted by controlling the number and sizes of the openings or slits 51 in the axially extending wall 37 of the skirted chamber 36. One advantage of the present invention is that the entire applicator head 22 including the slits 51 can be molded form plastic material in one piece. Thus, the desired flow rate of the flowable substance 24 can be reproduced with precision by forming the applicator head 22 with the slits 51 in the wall 37 in a simple molding operation.

The applicator head 22 can be mounted on the mounting member by a screw connection means 53 as shown in FIG. 8 or a push-pull means 54, as shown in FIG. 9. The screw connection means 53 allows the applicator head to move axially between the open and closed positions by rotating the applicator head 22 in relation to the mounting member 25. On the other hand, the push-pull means 54 allows the applicator head 22 to move axially between the open and closed positions by manually pulling and pushing on the applicator head 22 in relation to the mounting member 25. The screw connection means 53 comprises mutually engaging threads on the inner surface of the cylindrical sleeve 47 and the outer surface 46 of the tubular portion 41.

In the embodiment shown in FIG. 9, the applicator head 22 and the mounting member 25 include friction means 55 for inhibiting movement of the applicator head 22 from the open position to the closed position during use of the applicator head 22 to apply the flowable substance 24 on an article 26. The friction means 55 comprises a projection 56 on the mounting member 25 and an engaging member 57 on the applicator head 22. The engaging member 57 contacts the projection 56 when the applicator head is moved from the open position towards the closed position, the projection 56 causing the engaging member 57 to flex in a direction transverse to the axial direction for passage of the engaging member over the projection 56 when the applicator head 22 is moved to the closed position. In particular, the tubular portion 41 is comprised of a cylindrical wall 58 having a larger diameter section 59 at a lower end thereof, the section 59 comprising the projection 56 and the means 45 for sealingly engaging the outer surface 46 of the tubular portion 41 comprises the cylindrical sleeve 47 depending from the underside of the applicator means 33 and the circumferentially extending rim 48 at the lower end of the cylindrical sleeve 47, the rim 48 comprising the engaging member 57. To facilitate pushing and pulling on the applicator head 22, the lip 40 is connected to the cylindrical sleeve 47 by a plurality of vertically extending webs 60 therebetween, the webs 60 being spaced apart circumferentially around the applicator head 22 to allow better gripping of the applicator head 22 beneath the lip 40. The applicator 22 actuated by the screw connection means 53, on the other hand, does not include the webs 60 but rather a cylindrical wall 61 is provided depending from the lip 40, the wall 61 having vertically extending grooves 62 thereon for rotation thereof.

The applicator head, 22 shown in FIGS. 8 and 9 also includes means 64 for resisting removal of the applicator head 22 from the mounting member 25, the resisting means 64 comprising the cylindrical sleeve 49 and the rim 50 at the lower end thereof. The resisting means 64 also includes an abutment 65 on the upper end of the tubular portion 41, the abutment 65 extending transversely to the axial direction, as shown in FIG. 6. In the embodiment shown in FIG. 6, a pair of opposed abutments 65 are provided in the space between adjacent struts 42, the abutments 65 extending circumferentially no further than the joint between the struts 42 and the inner surface of the tubular portion 41 for allowing easy removal of the mounting member 25 from a mold after the mounting member 25 is molded in one piece from plastic. The abutment 65 engages the rim 50 when the applicator head 22 is in the open position to thereby resist removal of the applicator head 22 from the mounting member 25.

Another embodiment of the present invention is shown in FIGS. 10–13 wherein the mounting member 25 and the container body 23 include means 66 for preventing removal of the mounting member 25 from the container body 23. The removal preventing means 66 comprises a plurality of ratchet teeth 67 depending from the lower portion of the mounting member 25 and a plurality of lugs 68 on the container body 23. As shown in FIG. 9, the mounting member 25 is threadedly engaged with the container body 23 and the ratchet teeth 67 are flexible radially outwardly for passing over radially outer surfaces 69 of the lugs when the mounting member 25 is rotated in one direction into engagement with the container body 23. The lugs 68 have radially extending locking surfaces 70 for preventing removal of the mounting member 25 by rotation thereof in the opposite direction. The ratchet teeth 67 include forward surfaces 71 and rear surfaces 72, the forward surfaces 71 being inclined to the axial direction and the rear surfaces being parallel to the axial direction. Upon rotation of the mounting member 25 into threaded engagement with the container body 23, the forward surfaces 71 pass over the outer surfaces 69 of the lugs 68 such that the ratchet teeth 67 flex radially outwardly and the ratchet teeth 67 flex radially inwardly once the rear edges 72 thereof pass over the radially extending locking surfaces 70 of the lugs 68. It can be seen in FIGS. 12 and 13 that each of the lugs 68 include three radially outer surfaces, the first surface **69*a* extending from the outer surface of the container body 23 at a steeper angle than the second surface 69*b*, the second surface 69*b* being between the first surface 69*a* and the third surface 69*c* which is substantially perpendicular to the locking surface 70. From FIG. 13, it can be seen that the second surface 69*b* and third surface 69*c* are inclined to the axial direction at a suitable angle, such as about 10 degrees. The first surface 69*a* can be inclined to the locking surface at an angle of about 15 degrees and the second surface 69*b* can be inclined to the locking surface at an angle of about 55 degrees. The locking surface 70 can also form an angle with the third surface 69*c* slightly larger than 90 degrees, such as 95 degrees. Furthermore, the ratchet teeth 67** can be inclined to the axial direction such that the lower ends of the ratchet teeth are inclined outwardly at-an angle of about 10 degrees to the upper ends thereof.

Although the present invention has been described with reference to the foregoing embodiments, it will be apparent to those skilled in the art that numerous variations can be made in such preferred embodiments without departing from the invention or the scope of the appended claims.

We claim:

1. A vented package in combination with at least one dispenser; said at least one dispenser having an applicator head fitted thereto and containing a volatile liquid product; said at least one dispenser containing the volatile liquid housed within the vented package; and the vented package comprising a base member extending in a longitudinal direction and having a cavity therein said cavity forming an opening in a peripheral surface of an upper end of said base member, and said at least one dispenser containing the volatile liquid being received in said cavity in such a manner as to be removable from said base member through said opening, an overcap extending in said longitudinal direction and having a lower end removably fitted over said opening in said base member, and vent means disposed on at least one of said base member and said overcap for preventing at least one of loss in tensile strength, discoloration and crazing of said overcap due to natural slight loss of product vapors of the volatile liquid through said closure on the at least one dispenser.

2. The vented package of claim 1, wherein said overcap comprises clear plastic material having a rim at said lower end thereof, said base member including a ridge around said upper end thereof engageable with said rim of said overcap for removably securing said overcap and said base member together.

3. The vented package of claim 2, wherein said vent means includes at least one longitudinally extending channel formed in an inner surface of said rim of said overcap.

4. The vented package of claim 1, wherein said at least one dispenser is elongated and has an applicator head at one end, said dispenser being stored in said vented package with said applicator head located within and adjacent to said top wall of said overcap.

5. The vented package of claim 4, wherein said at least one elongated dispenser comprises three dispensers, each of said dispensers having an applicator head, said three dispensers being stored in said vented package with each said applicator head being located within and adjacent said upper end of said overcap.

6. The vented package of claim 1, wherein said overcap includes flex means at said lower end thereof for flexing of said lower end of said overcap radially inwardly to avoid cracking of said low end of said overcap due to squeezing thereof during removal from the base member, said flex means comprising a plurality of longitudinally extending channels in an inner surface of said overcap at said lower end thereof, said channels also forming part of said vent means.

7. A vented package comprising a base member, a clear plastic overcap and at least one dispenser; wherein the dispenser (a) has an applicator head fitted thereto and (b) contains a volatile liquid;

the base member, extends in a longitudinal direction, and has a cavity which forms an opening in a peripheral surface of an upper end of the base member, the dispenser containing the volatile liquid being received in said cavity in such a manner as to be removable from said base member through said opening, the clear plastic overcap extending in said longitudinal direction and having a rim at its lower end removably fitted over the opening in said base member which includes a ridge around said upper end thereof engagable with the rim of the overcap for removably securing the overcap to the base member, and vent means for venting vapors comprising at least one aperture extending through said overcap, the aperture being spaced from a portion of said overcap removably fitted over the opening in the base member, and wherein the overcap and the base member include portions thereof which further constitute the vent means, and which portions are spaced from one another so as to define at least one passage therebetween open to the interior of the overcap and to the exterior of the vented package whereby venting of vapors having a density greater than air is effected by passage of air into said vented package through said aperture and passage of vapors and air out of said vented package through said at least one passage.

8. The vented package of claim 7, wherein said overcap comprises a tubular member closed at an upper end thereof by a top wall, said at least one aperture comprising a single aperture disposed in said top wall of said overcap.

9. The vented package of claim 8, wherein said base member comprises a tubular body closed at one end thereof by a bottom wall, said at least one passage being a recess extending radially inwardly from an outer periphery of said tubular body, said recess extending in said longitudinal direction towards said opening in said base member and separating said ridge on said base member into first and second sections thereof for passage of gasses inwardly and outwardly of said vented package.

10. A vented package comprising a base member, an overcap and at least one dispenser; wherein the dispenser (a) has an applicator head fitted thereto and (b) contains a volatile liquid product;

the base member, extends in a longitudinal direction and has a cavity therein which forms an opening in a peripheral surface of an upper end of the base member, the dispenser containing the volatile liquid being received in said cavity in such a manner as to be removable from said base member through said opening;

the overcap extending in said longitudinal direction and having a lower end removably fitted over the opening in said base member; and vent means for venting vapors comprising portions of said overcap and said base member spaced from one another to define a pair of passages between said overcap and said base member, and at least one aperture extending through said overcap at a position spaced from a portion of said overcap fitted over said opening in said base member, each of said passages being a recess extending radially inwardly from an outer periphery of said base member at a position spaced from said opening in said base member, said recess extending in said longitudinal direction towards and terminating at a point which is coplanar with said upper end of said base member defining said opening in said base member.

11. A vented package housing at least one dispenser fitted with a closure and containing a volatile liquid product, the vented package comprising:

a base member extending in a longitudinal direction and having a cavity therein for receiving the at least one dispenser, said cavity forming an opening in a peripheral surface of an upper end of said base member;

an overcap extending in said longitudinal direction and having a lower end removably fitted over said opening in said base member; and vent means is for venting vapors being disposed on said overcap, said vent means comprising at least one aperture extending through said overcap at a position spaced from a portion of said overcap removably fitted over said opening in said base member and at least one channel in an inner surface of said portion, said at least one channel forming a space between an outer periphery of said base member and said inner surface of said overcap to allow passage of gasses inwardly and outwardly of said vented package.

12. The vented package of claim 11, wherein said at least one channel comprises three pairs of diametrically opposed longitudinally extending channels which are spaced circumferentially apart adjacent said lower end of said overcap.

* * * * *